US010866064B2

(12) United States Patent
Weiszl

(10) Patent No.: US 10,866,064 B2
(45) Date of Patent: Dec. 15, 2020

(54) ADJUSTING TURRET FOR A LONG-RANGE OPTICAL DEVICE

(71) Applicant: Kahles Gesellschaft m.b.H., Guntramsdorf (AT)

(72) Inventor: Gunther Weiszl, Moellersdorf (AT)

(73) Assignee: Kahles Gesellschaft m.b.H., Guntramsdorf (AT)

( * ) Notice: Subject to any disclaimer, the term of this patent is extended or adjusted under 35 U.S.C. 154(b) by 0 days.

(21) Appl. No.: 15/827,052

(22) Filed: Nov. 30, 2017

(65) Prior Publication Data

US 2018/0156574 A1 Jun. 7, 2018

(30) Foreign Application Priority Data

Dec. 1, 2016 (AT) ..... A 51093/2016

(51) Int. Cl.

| | |
|---|---|
| ***F41G 1/38*** | (2006.01) |
| ***G05G 1/12*** | (2006.01) |
| ***G05G 1/10*** | (2006.01) |
| ***G05G 5/00*** | (2006.01) |
| ***F41G 1/30*** | (2006.01) |

(52) U.S. Cl.
CPC *F41G 1/38* (2013.01); *F41G 1/30* (2013.01)

(58) Field of Classification Search
CPC .. F41G 1/38; F41G 1/16; G02B 23/16; G02B 23/14; G05G 1/12; G05G 1/10; G05G 5/005
See application file for complete search history.

(56) References Cited

U.S. PATENT DOCUMENTS

| | | | | |
|---|---|---|---|---|
| 6,351,907 | B1 | 3/2002 | Otteman | |
| 6,995,905 | B2 | 2/2006 | Wagner | |
| 7,612,952 | B2 | 11/2009 | Schaefer | |
| 7,742,228 | B2 | 6/2010 | Fiedler | |
| 7,997,163 | B2 | 8/2011 | Casas | |
| 8,270,104 | B2 | 9/2012 | Windauer | |
| 8,848,287 | B2 | 9/2014 | Schmitt et al. | |
| 9,188,408 | B2 | 11/2015 | Huynh | |
| 9,958,235 | B2 | 5/2018 | Lassak et al. | |
| 2016/0178323 | A1* | 6/2016 | Ottl | F41G 3/32 74/532 |
| 2018/0120059 | A1* | 5/2018 | White | F41G 1/38 |

FOREIGN PATENT DOCUMENTS

| | | | |
|---|---|---|---|
| DE | 29720737 | U1 | 2/1998 |
| DE | 10 2006 016 834 | A1 | 10/2007 |
| DE | 10 2010 060 343 | A1 | 5/2011 |
| EP | 1 746 451 | B1 | 1/2007 |
| EP | 2 466 245 | A2 | 6/2012 |
| WO | 02/082003 | A2 | 10/2002 |
| WO | 2010/008810 | A2 | 1/2010 |

* cited by examiner

*Primary Examiner* — Luis A Gonzalez
(74) *Attorney, Agent, or Firm* — Collard & Roe, P.C.

(57) ABSTRACT

An adjusting turret for a telescopic sight or reflex sight includes a rotary cap, which is rotatable about a rotary axis by applying a first torque, as an actuator for a spindle, wherein the rotary cap includes at least one rotation stop which is rotatable relative to the spindle about the rotary axis by applying a second torque that is smaller than the first torque, wherein the adjusting turret has at least one scale which is arranged on a part that is separate from the rotation stop.

5 Claims, 4 Drawing Sheets

ADJUSTING TURRET FOR A LONG-RANGE OPTICAL DEVICE

CROSS REFERENCE TO RELATED APPLICATIONS

Applicant claims priority under 35 U.S.C. § 119 of Austrian Application No. A51093/2016 filed on Dec. 1, 2016, the disclosure of which is incorporated by reference.

The invention relates to an adjusting turret for a long-range optical device, in particular for a telescopic sight or reflex sight, wherein the adjusting turret comprises a rotary cap which is rotatable about a rotary axis by applying a first torque as an actuating element for a spindle.

In telescopic sights for example the height or lateral position of a line of sight can be adjusted according to the ammunition used and/or the distance from the target. The adjustment of the line of sight is usually performed by means of an adjusting turret, which has a rotary cap which can be rotated about a rotary axis and via a spindle acts on an adjustable optical system of the long-range optical device. In the case of a telescopic sight the adjustable optical system can be a reversible system mounted movably in a housing of the telescopic sight. Such a telescopic sight is known for example from EP174645161.

To rotate the rotary cap it is necessary to apply a torque or overcome rotational resistance. Such adjusting turrets produce a click on rotation which can be perceived clearly by the user and is caused by forcing out and re-engaging the locking element into the toothing. Each rotation by one click corresponds in this case to a defined lateral or height adjustment of the line of sight. An adjusting turret with a click adjustment is known for example from DE29720737U1.

However, there may be an unwanted or unintentional adjustment of the rotary cap during operation. Thus it is possible for example that a user may touch the rotary cap and move the latter unintentionally (unwanted adjustment) or the user may knock the rotary cap or it may get caught and he may not notice that an adjustment has occurred (unintentional adjustment).

Various different solutions for securing the rotary cap are known for preventing the undesirable or unintentional rotation of the rotary cap and thus the unwanted adjustment of the telescopic sight.

Thus from U.S. Pat. No. 7,997,163 for example it is known to move an adjusting turret by pulling it out of a locked position into a position in which it rotates freely and the line of sight can be adjusted. The adjusting turret can be pushed back into the locked position in this known solution.

The disadvantage of the known solutions is that the latter are restricted in terms of their manipulation, as relatively complicated movement sequences are necessary for unlocking the adjusting turret.

It is therefore an objective of the invention to provide an easy to manipulate means for protecting against the undesirable and unintentional rotation of an adjusting turret, which is characterized by having a simple structure.

Said objective is achieved according to the invention by an adjusting turret of the aforementioned kind in that the rotary cap comprises at least one rotation stop which is rotatable relative to the spindle about the rotary axis by applying a second torque smaller than the first torque, wherein the adjusting turret has at least one scale which is provided on a part separate from the rotation stop.

By means of the solution according to the invention the rotation stop absorbs all of the torque acting on the rotary cap which is produced unintentionally or without the knowledge of the user. Thus if the rotary cap gets caught on a surface, for example on a doorway, the rotation stop can run on said surface like a wheel, whereby only the rotation stop rotates but the remaining parts of the rotary cap are not rotated relative to the rotary axis and thus the long-range optical device is not adjusted. By arranging the rotation stop on particularly exposed parts of the rotary cap the latter is protected from all kinds of unwanted and unintentional rotation. Said particularly exposed parts of the rotary cap include those parts which face away from a housing of the long-range optical device, in particular a telescopic sight. Usually said exposed parts consist of contact surfaces, which enable the rotation of the rotary cap during normal operation by a user. Normal operation is defined here as the proper use of the long-range optical device, in particular the telescopic sight.

According to an advantageous variant of the invention the rotary cap can have at least one first part connected in a rotationally secure manner to the spindle, wherein the rotation stop is mounted rotatably on the at least one first part connected in a rotationally secure manner to the spindle. By means of this embodiment the unintentional adjustment of an optical system of the long-range optical device can be prevented very reliably.

In one embodiment of the invention, which is characterized by being very easy to manipulate, it is possible that the rotation stop is designed as a ring which runs annularly about the part connected in a rotationally secure manner to the spindle, and which can be fixed in particular by means of at least one actuation lever relative to the part connected in a rotationally secure manner to the spindle.

According to a further variant of the invention it is possible that the adjusting turret comprises one or more rings comprising at least one marking, wherein, if the adjusting turret has exactly one ring comprising at least one marking, the rotation stop is separated from said ring and if the adjusting turret comprises a plurality of such rings, the rotation stop is separated structurally from all of said rings of the adjusting turret. By means of this variant of the invention it is possible to very efficiently prevent the rotation the rotation stop causing an adjustment of a marking of the adjusting turret.

An embodiment has proved to be particularly advantageous in which the rotation stop forms an at least partial end face cover of the rotary cap and/or a cover of a radially outer side face of the rotary cap.

For a better understanding of the invention the latter is explained in more detail with reference to the following Figures.

In a much simplified, schematic representation:

Figure 1:
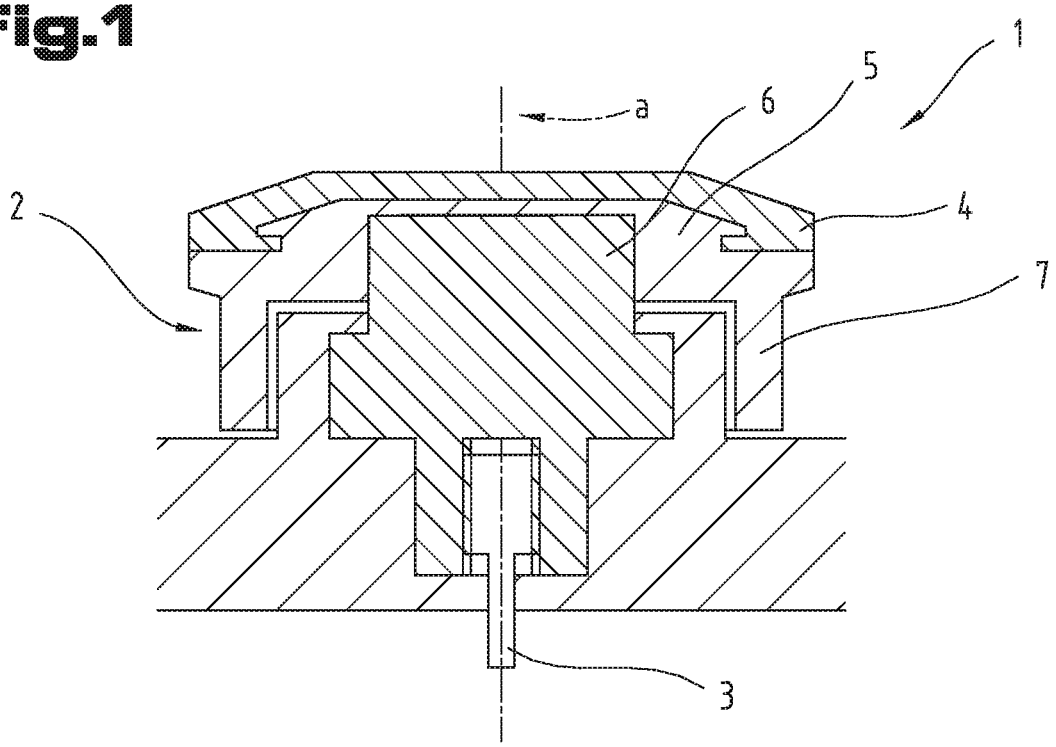
FIG. 1 is a cross-section of a first variant of an adjusting turret according to the invention.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

According to FIG. 1 an adjusting turret 1 according to the invention for a long-range optical device, in particular for a telescopic sight, comprises a rotary cap 2 which is rotatable about a rotary axis a. The rotary cap 2 is used as an actuator for a spindle comprising parts 3 and 6 in the shown example embodiment and can be rotated by the application of a first torque about the rotary axis a. According to the invention the rotary cap 2 comprises a rotation stop 4 which is rotatable relative to the spindle about the rotary axis a. For rotating the rotation stop 4 a smaller torque is needed than for activating the spindle, in this way in the case of a torque accidentally acting on the rotary cap 2 the rotation stop 4 is set into rotation, before the spindle can be activated. For example, if the rotary cap 2 comes into contact with a surface of an object, the rotation stop 4 can roll on said surface like a wheel and can thus prevent the unwanted or unintentional rotation of the spindle by means of the rotary cap 2.

Furthermore, the rotary cap 2 comprises a first part 5 connected rotationally securely to the spindle. The part 5 of the rotary cap 2 can thus be connected rotationally securely to a part 6 of the spindle. By rotating the part 6, for example a spindle nut, the part 3 acting on an optical system, for example a screw, can be moved translationally along the rotary axis a and a position of the adjustable optical system can be changed. Of course, it is also possible for part 6 to perform a rotational movement and part 3 to perform a rotational and translational movement.

To produce the rotationally secure connections of parts 5, 6 and the spindle for example set screws can be used. The rotation stop 4 is mounted rotatably in said example embodiment on the at least one first part 5 connected rotationally securely to the spindle.

Figure 5:
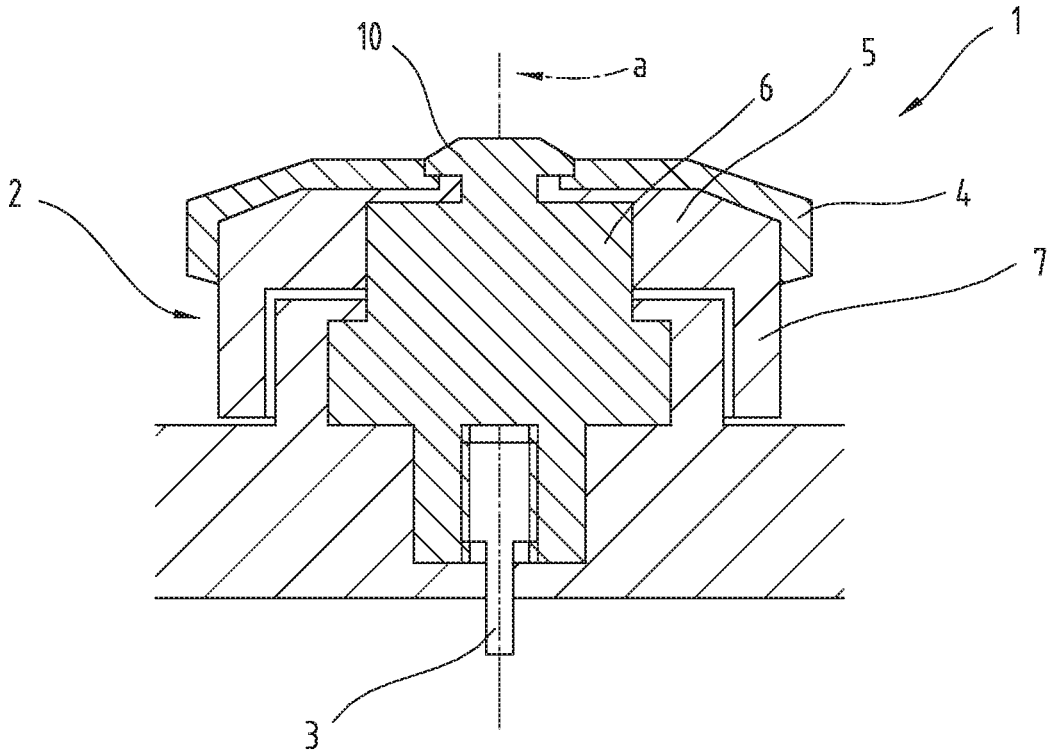
FIG. 5 is a cross-section of a fifth variant of an adjusting turret according to the invention.
Figure 6:
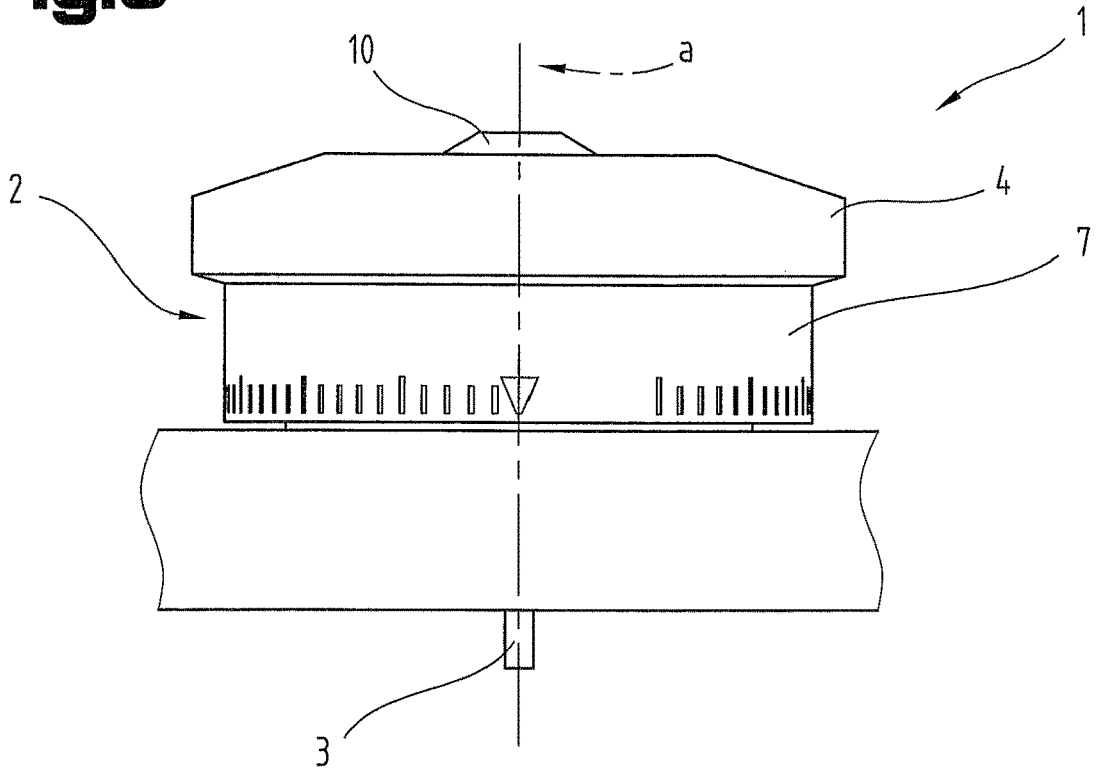
FIG. 6 is a side view of the embodiment of FIG. 5 showing a scale.

Furthermore, the adjusting turret 1 comprises at least one scale, not shown in FIG. 5, which is provided on a part separate from the anti-twist protection device 4. The part comprising said scale can consist of an external side face of part 5 annularly surrounding the rotary axis a. The scale is thus located on a ring 7.

The ring 7 does not always need to be coupled to the part 5 or formed in one piece with the latter as in the shown example embodiment. Thus the ring 7 can also be a separate component which can be uncoupled from part 5 and can be displaced along the rotary axis a independently of the latter or can be rotated about the latter.

Figure 7:
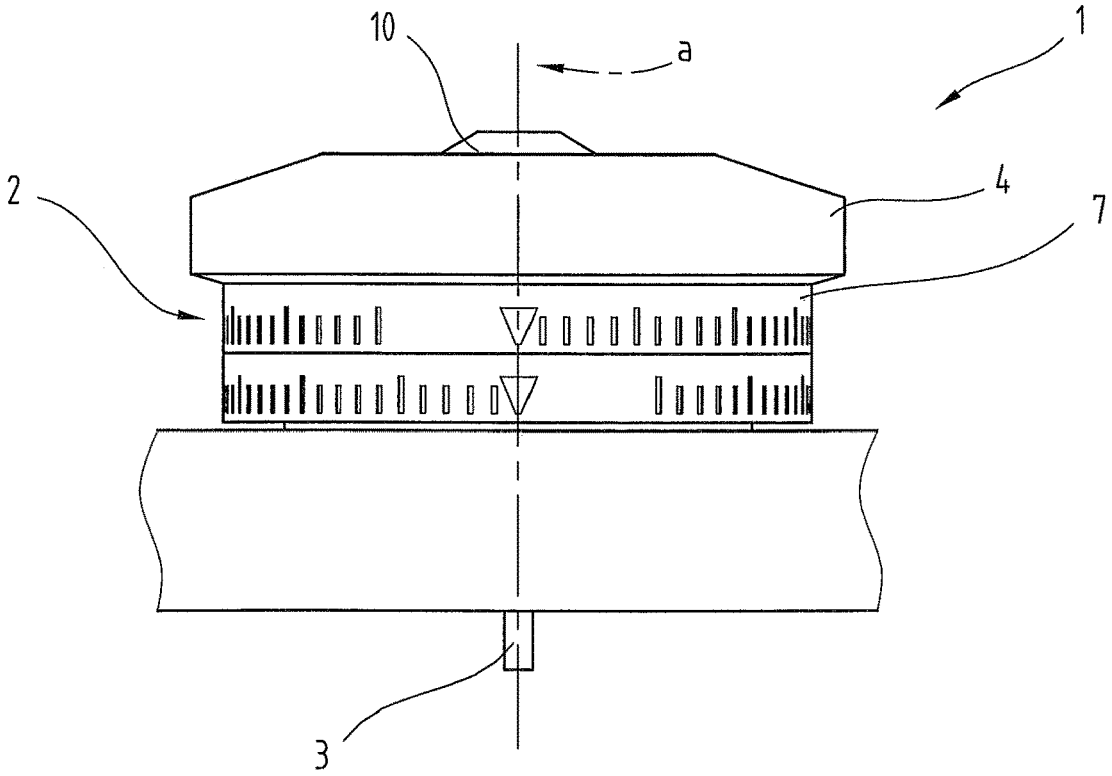
FIG. 7 is a side view of an adjusting turret comprising one or more rings with at least one marking.

Instead of one ring 7 however also a plurality of rings 7 can each be provided with at least one marking. See FIG. 7. If the adjusting turret 1 has exactly one ring 7 the anti-twist protection device 4 is structurally separate from said ring 7 and if the adjusting turret 1 has a plurality of rings 7 with markings the anti-twist protection device is structurally uncoupled from all of said rings 7.

As shown in FIG. 1, the rotation stop 4 can have an end face cover of the rotary cap 2 and can form a cover for a radially outerlying side face of the rotary cap 2.

Figure 2:
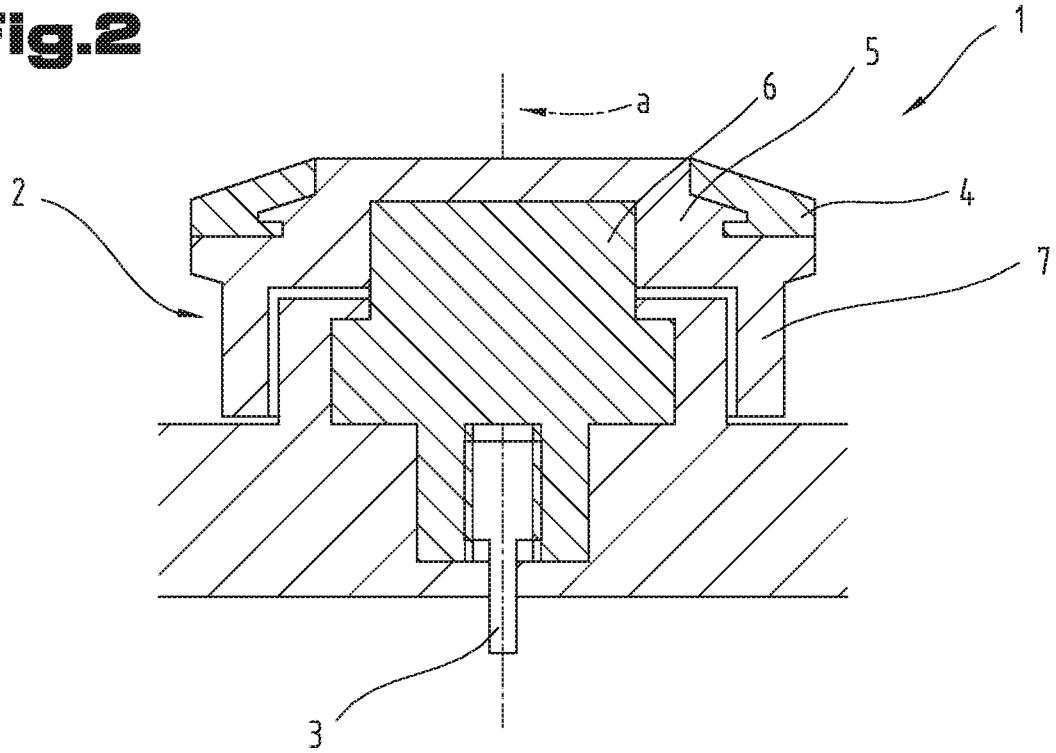
FIG. 2 is a cross-section of a second variant of an adjusting turret according to the invention.

FIG. 2 shows an additional and possibly independent embodiment of the adjusting turret, wherein the same reference numerals and component names are used for the same parts as for the preceding FIG. 1. To avoid unnecessary repetition, reference is made to the detailed description of the preceding FIG. 1.

According to FIG. 2 the rotation stop 4 is designed as a ring rotating annularly about the part 5 connected rotationally securely to the spindle. In contrast to the embodiment shown in FIG. 1 here the rotation stop 4 does not fully cover an end face of the rotary cap 2.

Figure 3:
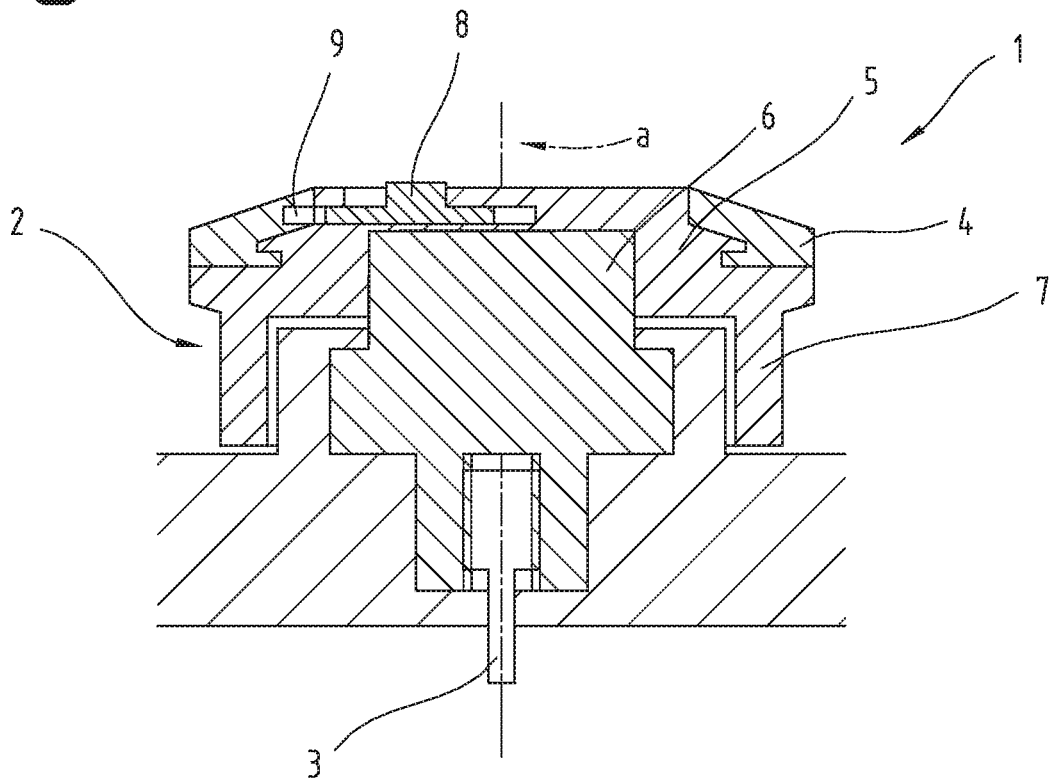
FIG. 3 is a cross-section of a third variant of an adjusting turret according to the invention.

FIG. 3 shows a further and possibly independent embodiment of the adjusting turret, wherein the same reference numerals and component names are used for the same parts as in the preceding FIGS. 1 and 2. To avoid unnecessary repetition, reference is made to the detailed description of the preceding FIGS. 1 and 2.

The embodiment shown in FIG. 3 differs from the one shown in FIG. 2 in that a fixing mechanism is provided for locking the rotation stop 4. It is particularly advantageous that the rotation stop 4 designed as a peripheral ring can be locked by means of at least one actuation lever 8. In this way if necessary the rotation stop 4 can be locked in a simple way, if desired by a user. The actuation lever 8 can engage in a locking position, for example in a corresponding recess 9 of the rotation stop and can fix the rotation stop 4 in the locking position relative to part 6 of the spindle. As illustrated the rotation stop 4 is uncoupled in a release position from part 6 of the spindle relative to a rotation about the rotary axis a and can rotate independently of the spindle.

It should be noted at this point that the shown actuation lever 8 is simply an example of a design and the latter can also be designed differently, for example in the form of a pivot lever or rocker lever.

In addition, it should be noted that in all other shown embodiments an actuation lever 8 can also be used.

Figure 4:
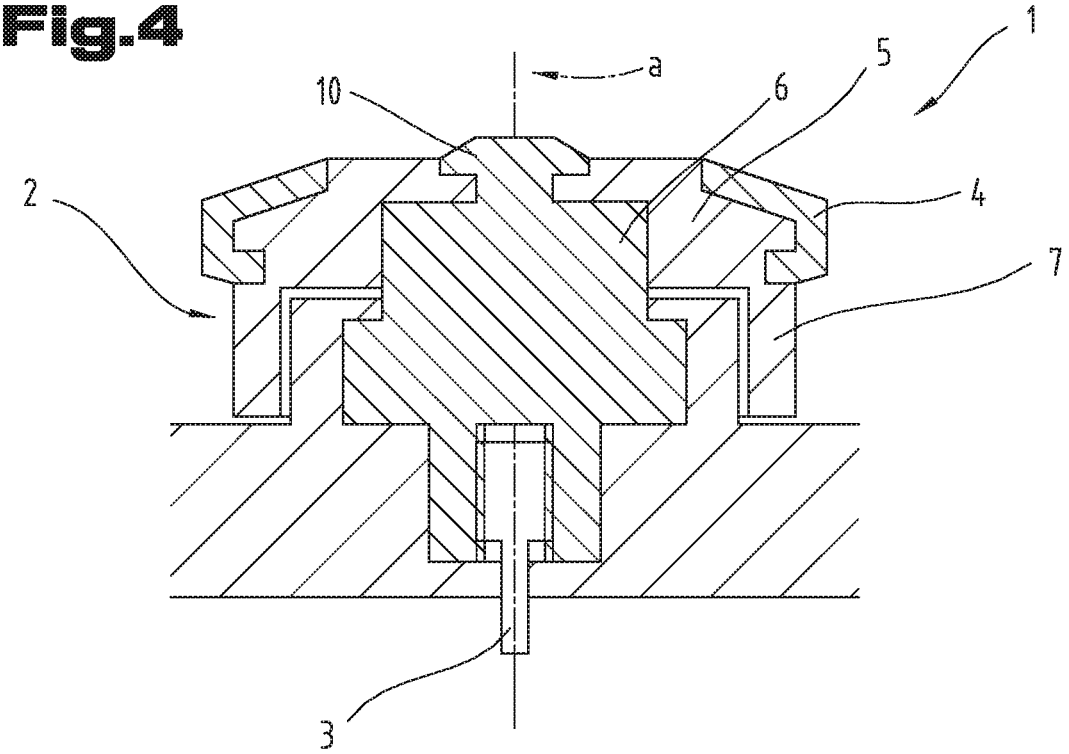
FIG. 4 is a cross-section of a fourth variant of an adjusting turret according to the invention.

FIG. 4 shows a further and possibly independent embodiment of the adjusting turret, wherein the same reference numerals and component names are used for the same parts as in the preceding Figures. To avoid unnecessary repetition, reference is made to the detailed description of the preceding figures.

FIG. 4 differs from the embodiment shown in FIG. 2 mainly in the shape of part 6, which here comprises a head 10 which forms a form-fitting closure with the rotary cap 2. The form-fitting closure can be designed so that the user can remove and mount the part 4 without causing any damage.

FIG. 5 shows a further and possibly independent embodiment of the adjusting turret, wherein the same reference numerals and component names are used for the same parts as in the preceding Figures. To avoid unnecessary repetition, reference is made to the detailed description of the preceding figures.

As shown in FIG. 5, the rotation stop 4 is held between the head 10 and the part 5 and forms a cover for exposed parts of the rotary cap 2, in this case the end face and side faces of the rotary cap 2. By means of the slight rotatability of the rotation stop 4 about the rotary axis a independently of the spindle very effective rotational protection can be achieved for the rotary cap 2.

According to FIG. 5 the rotation stop 4 can be centered by part 6 of the spindle and fixed against part 5 of the rotary cap 2.

Lastly, as a point of formality it should be noted that for a better understanding of the structure the elements have in part not been illustrated to scale and/or have been enlarged and/or reduced in size.

LIST OF REFERENCE NUMERALS

1 adjusting turret
2 rotary cap

3 part of the spindle
4 rotation stop
5 part of the rotary cap
6 part of the spindle
7 ring
8 actuation lever
9 recess
10 head
a rotary axis

The invention claimed is:

1. An adjusting turret for a long-range optical device, wherein the adjusting turret comprises a rotary cap comprising first and second parts rotatable about a rotary axis by applying a first torque, as an actuator for a spindle, wherein the rotary cap comprises at least one anti-twist protection device which is rotatable relative to the spindle about the rotary axis by applying a second torque that is smaller than the first torque, wherein the adjusting turret has at least one scale which is arranged on a part that is separate from the anti-twist protection device, the anti-twist protection device protecting the first and second parts of the rotary cap from all torque which is produced unintentionally or without the knowledge of the user, and wherein in use if the rotary cap gets caught on a surface the anti-twist protection device can run on said surface like a wheel, whereby only the anti-twist protection device rotates but the first and second parts of the rotary cap are not rotated relative to the rotary axis.

2. The adjusting turret as claimed in claim 1, wherein the first part is connected in a rotationally secure manner to the spindle, wherein the anti-twist protection device is mounted rotatably on the first part connected rotationally securely to the spindle.

3. The adjusting turret as claimed in claim 2, wherein the anti-twist protection device is designed as a ring which runs annularly around the first part connected rotationally securely to the spindle, which ring can be fixed by at least one actuation lever relative to the first part.

4. The adjusting turret as claimed in claim 1, wherein the adjusting turret comprises one or more rings with at least one marking, wherein, if the adjusting turret has exactly one ring with at least one marking, the anti-twist protection device is structurally separate and can optionally be removed from said ring, and if the adjusting turret has a plurality of such rings the anti-twist protection device is structurally separate and can optionally be removed from all of said rings of the adjusting turret.

5. The adjusting turret as claimed in claim 1, wherein the anti-twist protection device forms an at least partial end face cover of the rotary cap and/or a cover of a radially outer side face of the rotary cap.

* * * * *